US012774185B2

(12) United States Patent
Ma et al.

(10) Patent No.: US 12,774,185 B2
(45) Date of Patent: Oct. 27, 2026

(54) APPARATUS FOR DISPENSING TIE WIRE

(71) Applicant: Klein Tools, Inc., Lincolnshire, IL (US)

(72) Inventors: Soo In Ma, Mansfield, TX (US); Jonathan Low, Fort Worth, TX (US)

(73) Assignee: Klein Tools, Inc., Lincolnshire, IL (US)

( * ) Notice: Subject to any disclaimer, the term of this patent is extended or adjusted under 35 U.S.C. 154(b) by 254 days.

(21) Appl. No.: 18/385,209

(22) Filed: Oct. 30, 2023

(65) Prior Publication Data

US 2025/0136403 A1 May 1, 2025

(51) Int. Cl.
*B65H 49/20* (2006.01)

(52) U.S. Cl.
CPC ..... *B65H 49/205* (2013.01); *B65H 2701/362* (2013.01)

(58) Field of Classification Search
USPC ..... 242/607, 607.2
See application file for complete search history.

(56) References Cited

U.S. PATENT DOCUMENTS 1,592,030 A * 7/1926 Langsner ..... G01B 3/1005 242/405
2,982,491 A * 5/1961 Beiderwell ..... A47F 13/04 D8/358
3,249,319 A * 5/1966 Wasson ..... E04G 21/122 242/588.1
3,313,498 A * 4/1967 Wasson ..... E04G 21/123 242/588
8,882,016 B1 * 11/2014 Melvin ..... B65H 75/4492 242/405
9,796,556 B1 * 10/2017 Hill ..... B65H 49/32
11,634,299 B2 * 4/2023 Hawkins ..... B65H 75/446 242/588.1
2004/0026561 A1 * 2/2004 Martin ..... B65H 49/205 242/588.1
2007/0045460 A1 * 3/2007 Cupan ..... B65H 54/585 242/388.1

OTHER PUBLICATIONS

Southco TL Slide Latch Product Description and Catalog Page (Year: 2021).*

* cited by examiner

*Primary Examiner* — Anna M Momper
*Assistant Examiner* — Tiffany Domonique Jefferson

(57) ABSTRACT

An apparatus for dispensing tie wire having a housing with a main housing part and a cover part. The cover part is releasably joined with the main housing part to thereby place the main housing part and cover part in an assembled relationship wherein a wrapped supply of tie wire is blocked in an operative position within the housing. A latch component is selectively movable between latched and unlatched positions. In the latched position the main housing part and cover part are maintained in the assembled relationship. A latch control is selectively changeable between first and second states, and: i) with the latch control in the first state, the latch control blocks the latch component from moving from the latched position into the unlatched position; and ii) with the latch control in the second state, the latch component can be moved from the latched position into the unlatched position.

20 Claims, 7 Drawing Sheets

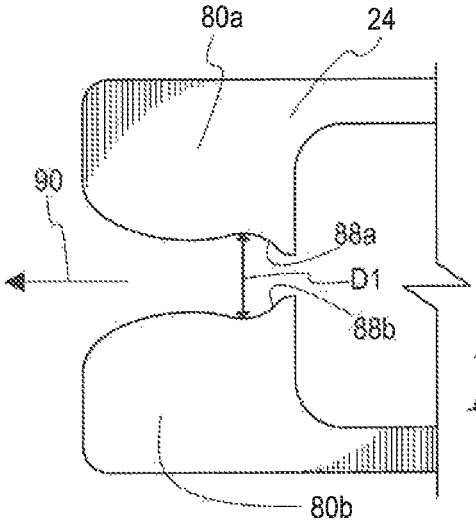
Fig. 8
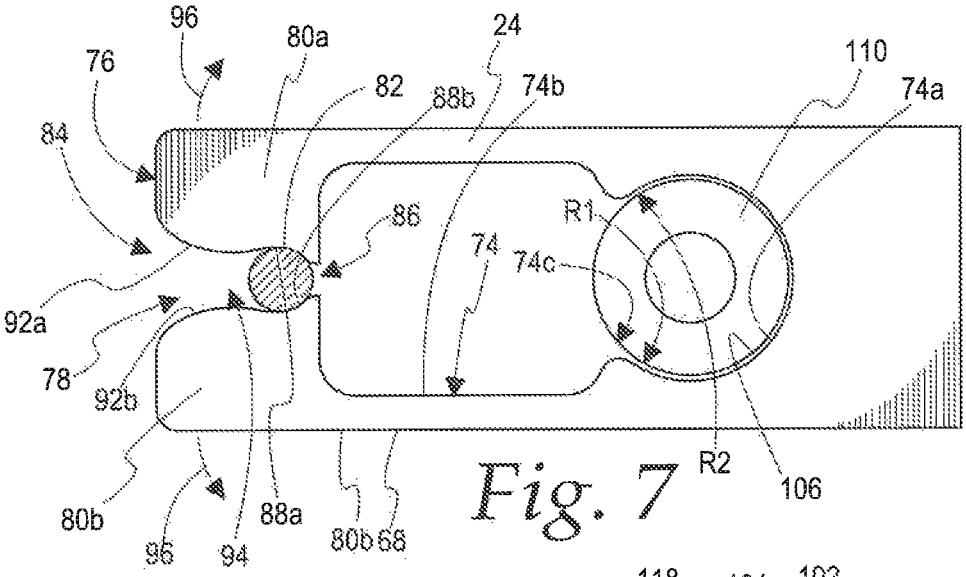
Fig. 7
Fig. 9
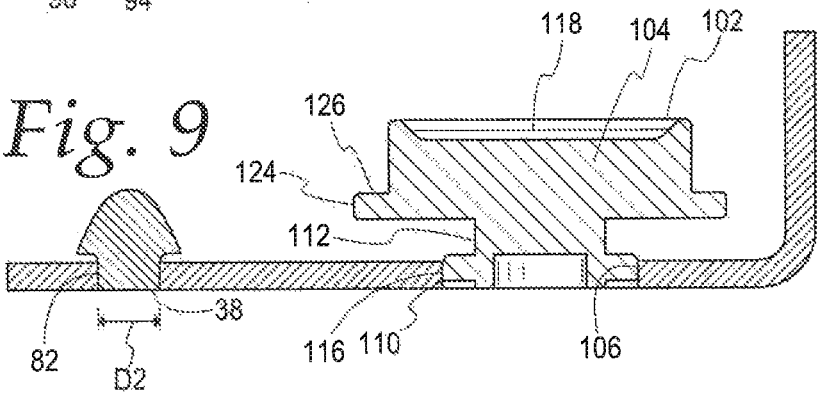
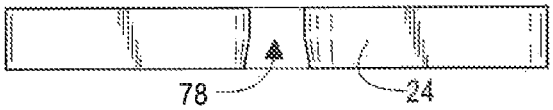
Fig. 10

Fig. 19
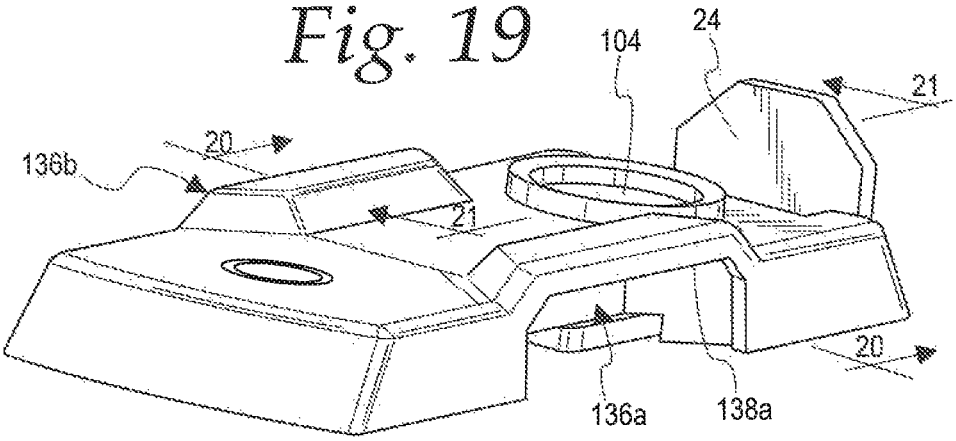
Fig. 20
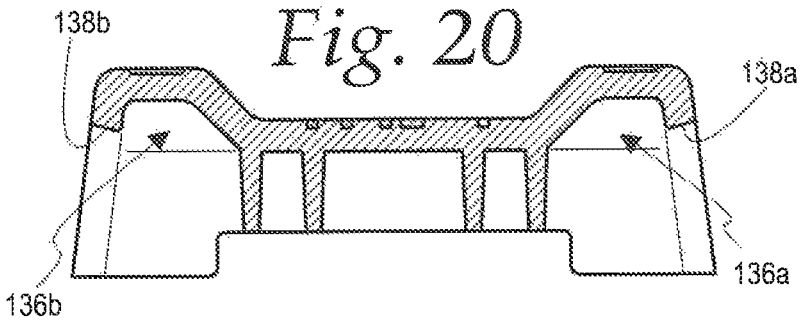
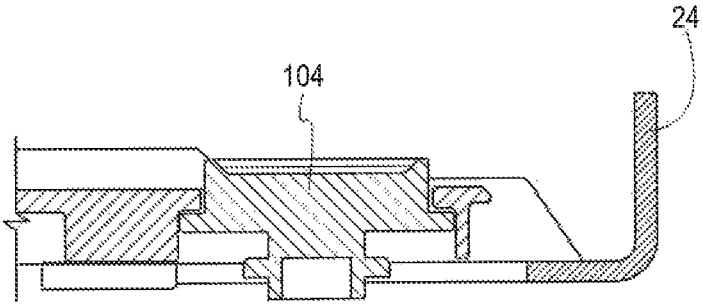
Fig. 21

APPARATUS FOR DISPENSING TIE WIRE

BACKGROUND OF THE INVENTION

Field of the Invention

This invention relates to tie wire dispensing and, more particularly, to an apparatus that facilitates controlled extension of tie wire from a wrapped supply of tie wire contained by the apparatus.

Background Art

Tie wire is used in a number of different industries. As an example, tie wire is commonly used in the construction industry, as to bind an accumulation of articles such as metal rebar. The use may occur in supply operations, on a job site, etc.

Tie wire generally is metal wire with a gauge of 12-18, with this range not being limiting. This tie wire is heavy enough and rigid enough that dispensers therefor are generally made with relatively robust components.

In one common dispensing design, a housing is formed with separable parts between which a wrapped supply of tie wire is captive. The wrapped supply of tie wire is placed against a support, which is guidingly rotatable within a volume bounded by the housing. A free end of the wire is advanced through the housing and can be paid out by exerting a pulling force thereon and/or by turning the spool through an external handle.

Once a tie wire supply is exhausted, a new wrapped supply of the tie wire is placed in the housing. To accomplish this, it is necessary to separate the housing parts to gain access to the internal housing space. Various designs have been developed to maintain the housing parts releasably in their joined relationship. Designers commonly focus on a number of often competing objectives.

First of all, it is important to have the housing parts positively held in their joined relationship so that accidental separation thereof and escape of the tie wire supply do not occur.

At the same time, a user-friendly design is desirable to allow users to conveniently and efficiently effect separation of the joined housing parts and rejoin the same when tie wire replenishment has been effected.

Some existing designs lend themselves to accidental separation of the housing parts that may be caused by an inadvertent impact or force application that actuates the particular release mechanism.

In spite of the many different designs currently existing, the industry continues to make changes in tie wire dispensing apparatus to better address the above areas.

SUMMARY OF THE INVENTION

In one form, the invention is directed to an apparatus for dispensing tie wire. The apparatus includes: a housing having a main housing part and a cover part; a latch component that is selectively movable between latched and unlatched positions; and a latch control selectively changeable between first and second states. The main housing part defines a storage space for a wrapped supply of tie wire. The main housing part has an opening through which a wrapped supply of tie wire can be directed to be placed in an operative position. The cover part is configured to be releasably joined with the main housing part to thereby place the main housing part and cover part in an assembled relationship wherein a wrapped supply of tie wire in the operative position is blocked in the operative position. The latch component in the latched position prevents the main housing part and cover part from being changed from the assembled relationship. With the latch component in the unlatched position, the main housing part and cover part are changeable from the assembled relationship, whereby a wrapped supply of tie wire can be one of: a) directed through the main housing part opening into the operative position; and b) removed from the operative position in the storage space through the main housing part opening. The latch control is configured so that: i) with the latch control in the first state, the latch control blocks the latch component from moving from the latched position into the unlatched position; and ii) with the latch control in the second state, the latch component can be moved from the latched position into the unlatched position.

In one form, the apparatus is provided in combination with a wrapped supply of tie wire.

In one form, the latch component is translatable between the latched and unlatched positions.

In one form, the housing has at least one discharge opening through which an end length of the wrapped supply of tie wire in the operative position can be directed. The wrapped supply of the wire in the operative position is movable around a turning axis relative to the main housing part as the end length of the tie wire is drawn away from the housing to thereby dispense the tie wire.

In one form, the main housing part has a cantilevered spindle that defines the turning axis. The latch component in the latched position engages the cantilevered spindle.

In one form, with the main housing part and cover part in assembled relationship and the latch component in the latched position, axially oppositely facing surfaces on the latch component and cantilevered spindle are in confronting relationship. The latch component blocks the main housing part and cover part from being moved axially away from each other.

In one form, the latch control has an actuator that extends through an opening in the latch component bounded by at least one edge.

In one form, the actuator is movable between a first position and a second position. The latch control is in the first state with the actuator in the first position and in the second state with the actuator in the second position.

In one form, the actuator has a body with a first axis. The body is moved parallel to the first axis in changing between the first and second positions.

In one form, the body has first and second portions spaced along the first axis and with different configurations. The body is configured so that: a) with the body in the first position, the first portion of the body abuts the at least one edge to block movement of the latch component from the latched position into the unlatched position; and b) with the body in the second position the second portion of the body is movable within the latch component opening without blocking movement of the latch component from the latched position into the unlatched position.

In one form, the body is spring biased towards the first position.

In one form, the cover part has a stop surface that faces axially with respect to the first axis. The body has a surface that faces oppositely to the stop surface and abuts the stop surface so that the body is consistently biased into the first position.

In one form, the main housing part has a cantilevered spindle that defines a turning axis that extends through the wrapped supply of tie wire in the operative position. The turning axis is substantially parallel to the first axis.

In one form, the spindle and latch component are configured so that, as an incident of the latch component being translated from the unlatched position into the latched position, the latch component reconfigures such that the latch component is biasably snap-connected to the spindle with the latch component in the latched position.

In one form, the latch component has an "L" shape with transverse legs. The opening is defined through one of the transverse legs. The other of the transverse legs is configured to be grasped to facilitate movement of the latch component between the latched and unlatched positions.

In one form, the apparatus for dispensing tie wire further includes a support that is mounted to the main housing part for movement relative to the main housing part around a turning axis. The wrapped supply of tie wire in the operative position is placed against the support and movable with the support around the turning axis.

In one form, the cover part has at least first and second pieces between which parts of the latch and body are captively maintained.

In one form, the body is spring biased towards the first position. At least one of the first and second pieces has at least one surface facing along the first axis in one direction. The body is advanced along the first axis in the one direction in moving from the first position into the second position. The at least one surface is configured so that a user can brace at least a digit on one hand against the at least one surface while exerting a force on the body with another digit on the one hand, that urges the body from the first position towards the second position.

In one form, the at least one of the first and second pieces defines at least one concave receptacle opening in the one direction and into which a user's digit can project while being braced against the at least one surface.

In one form, the cover part is engageable with the support to move with the support around the turning axis. The cover part has a projecting knob spaced from the turning axis and graspable by a user to facilitate moving of the cover part and support around the turning axis.

BRIEF DESCRIPTION OF THE DRAWINGS

FIG. 7 is an enlarged, bottom view of a latch component on the apparatus in FIGS. 2-6 and with the latch component in a latched position relative to a part of the main housing part and showing an actuator on a latch control, as shown schematically in FIG. 1;

FIG. 8 is an enlarged, fragmentary, top view of a portion of the latch component in FIG. 7;

FIG. 9 is a cross-sectional view of the latch component and actuator as in FIG. 7 and with the latch control in a first state;

FIG. 10 is an enlarged, end elevation view of the latch component in FIGS. 7-9;

FIG. 19 is an enlarged, perspective view of a piece on the cover part in relationship to the actuator on the latch control and the latch component;

FIG. 20 is a cross-sectional view of the components taken along line 20-20 of FIG. 19; and FIG. 21 is a cross-sectional view of the components taken along line 21-21 of FIG. 19.

DETAILED DESCRIPTION OF THE PREFERRED EMBODIMENT

Figure 1:
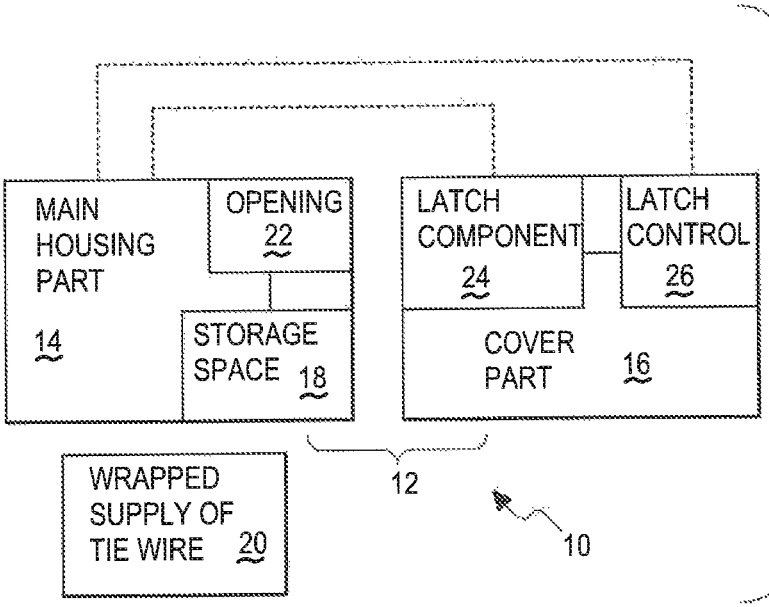
FIG. 1 is a schematic representation of an apparatus, according to the present invention, for dispensing tie wire, with a wrapped supply of tie wire schematically depicted.
Figure 2:
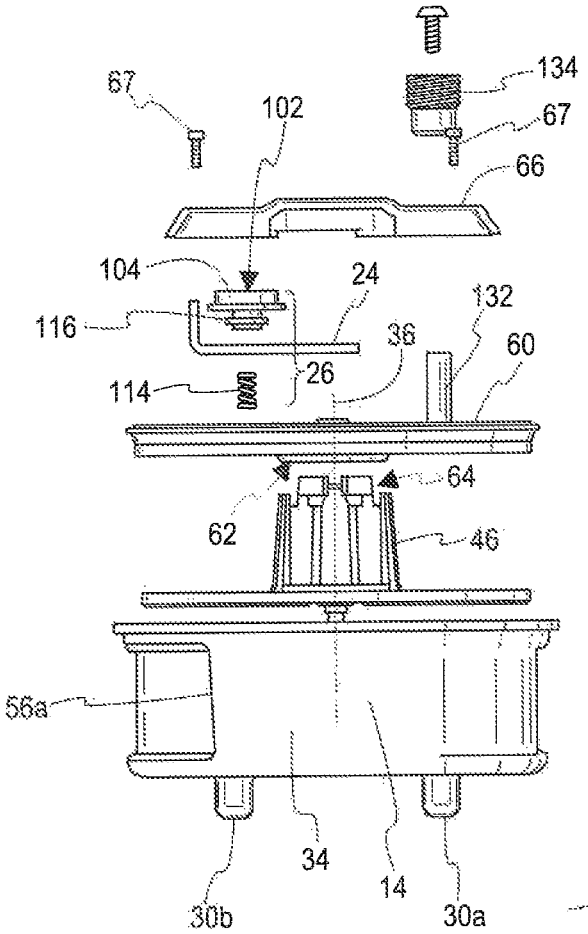
FIG. 2 is an exploded side view of one exemplary form of apparatus as depicted schematically in FIG. 1.
Figure 3:
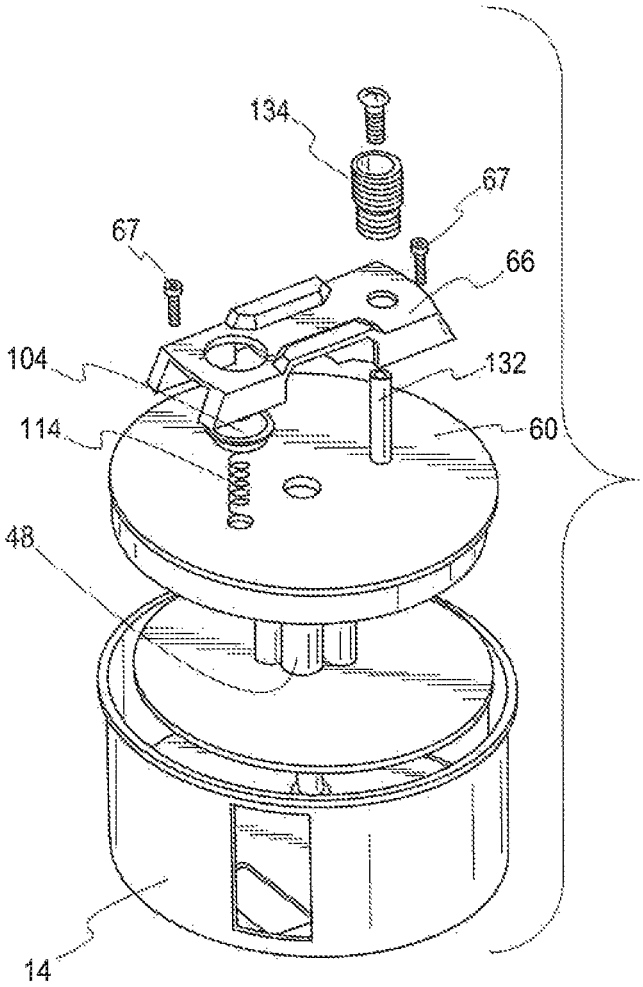
FIG. 3 is an exploded perspective view of the apparatus in FIG. 2.
Figure 4:
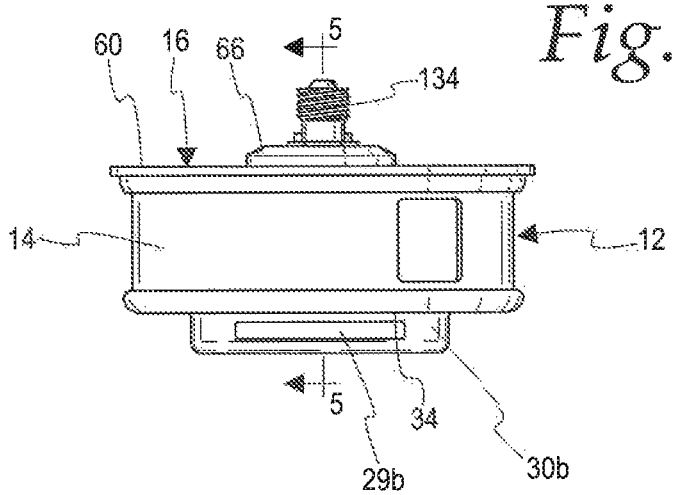
FIG. 4 is a side elevation view of the apparatus in FIGS. 2 and 3 with the parts thereof in an assembled state.

In FIG. 1, an apparatus for dispensing tie wire, according to the present invention, is shown schematically at 10. The apparatus 10 consists of a housing 12 made up of a main housing part 14 and a cover part 16.

The main housing part 14 defines a storage space 18 for a wrapped supply of tie wire 20. The main housing part 14 has an opening 22 through which the wrapped supply of tie wire 20 can be directed to be placed in an operative position.

The cover part 16 is configured to be releasably joined with the main housing part 14 to thereby place the main housing part 14 and cover part 16 in an assembled relationship wherein the wrapped supply of tie wire 20 in the operative position is blocked in the operative position.

A latch component 24 is selectively movable between latched and unlatched positions.

In the latched position, the latch component 24 prevents the main housing part 14 and cover part 16 from being changed from the assembled relationship such that the wrapped supply of tie wire 20 in the operative relationship can be separated from the main housing part 14.

With the latch component 24 in the unlatched position, the main housing part 14 and cover part 16 are changeable from the assembled relationship, whereupon the wrapped supply of tie wire 20 can be one of: a) directed through the opening 22 on the main housing part 14 into the operative position; and b) removed from the operative position in the storage space 18 through the opening 22 in the main housing part 14.

The apparatus 10 further has a latch control 26 that is selectively changeable between first and second states. The latch control 26 is configured so that: a) with the latch control 26 in the first state, the latch control 26 blocks the latch component 24 from moving from the latched position into the unlatched position; and b) with the latch control 26 in the second state, the latch component 24 can be moved from the latched position into the unlatched position.

The schematic depictions in FIG. 1 are intended to encompass virtually an unlimited number of different variations of each of the components therein, as well as their interactions. The specific forms of the apparatus 10 described hereinbelow are exemplary in nature only and should not be viewed as limiting.

As just examples, while the latch component 24 and latch control 26 are shown on the cover part 16, they might be in part, or entirely, on the main housing part 14. This alternative configuration is identified with the dotted line connections to the main housing part 14.

The wrapped supply of tie wire 20 may take any form, including one wherein the tie wire is wrapped around a spool, with the spool and tie wire being movable together into and out of the storage space 18. Alternatively, the wrapped supply of tie wire may consist of the formed wire itself without any supporting structure around which the tie wire is wrapped for support, independently of the apparatus 10.

Further, the schematic depiction of the tie wire is intended to encompass virtually any gauge that is commonly used with this type of dispenser-typically in the range of 10-18 gauge. Use of a non-metal wire is also contemplated.

Further, the schematic depiction is intended to encompass not only different shapes but different materials of construction.

Referring now to FIGS. 2-21, an exemplary form of the apparatus 10 will be described.

Figure 6:
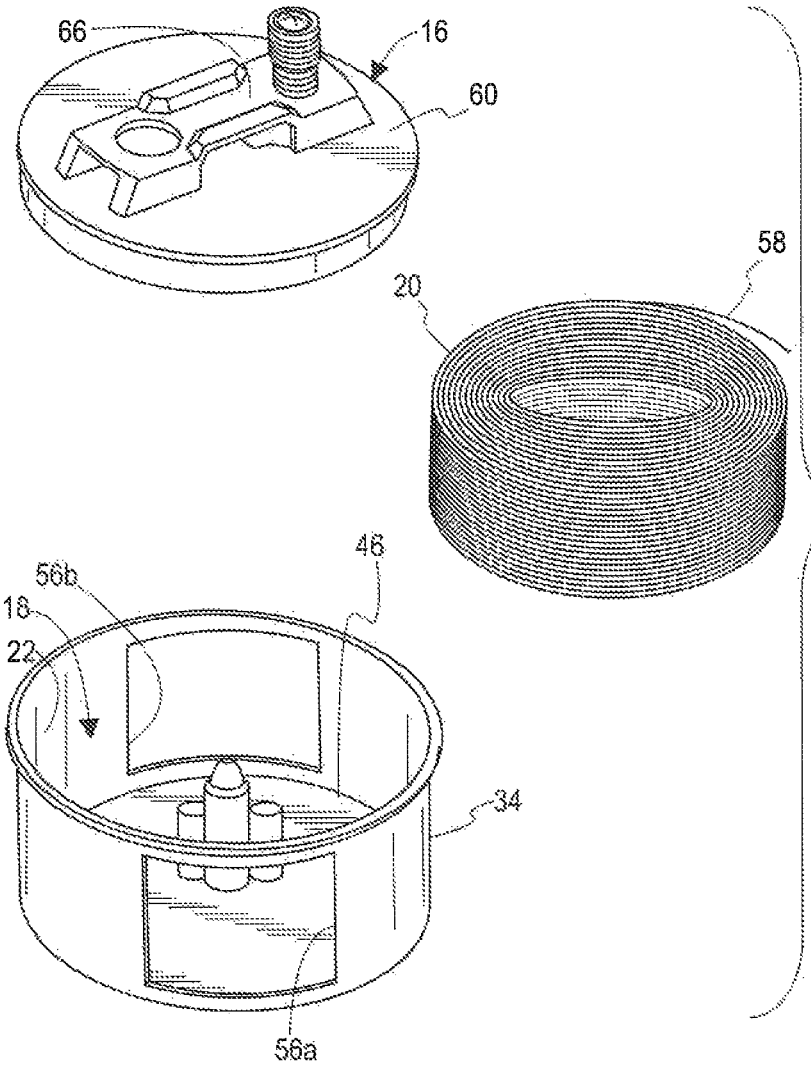
FIG. 6 is a perspective view of the apparatus in FIGS. 2-5 with a cover part separated from a main housing part and a wrapped supply of tie wire being directed into an operative position with respect to the main housing part.
Figure 5:
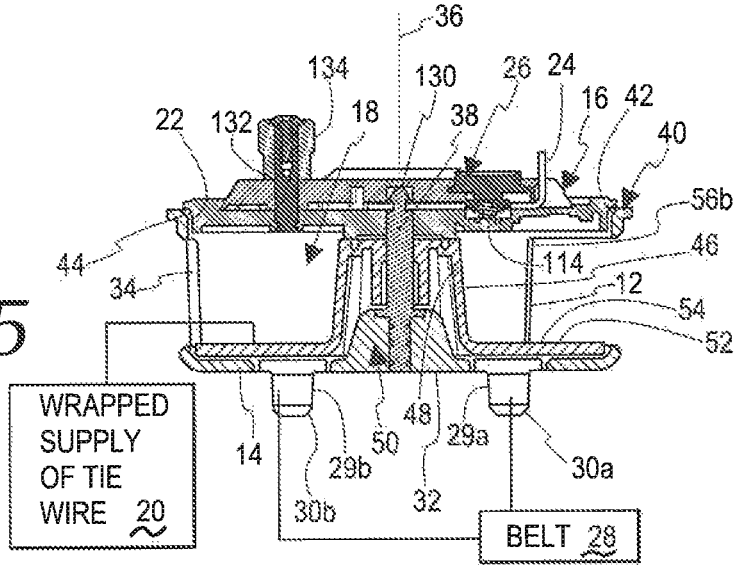
FIG. 5 is a cross-sectional view of the apparatus taken along line 5-5 of FIG. 4.
Figure 11:
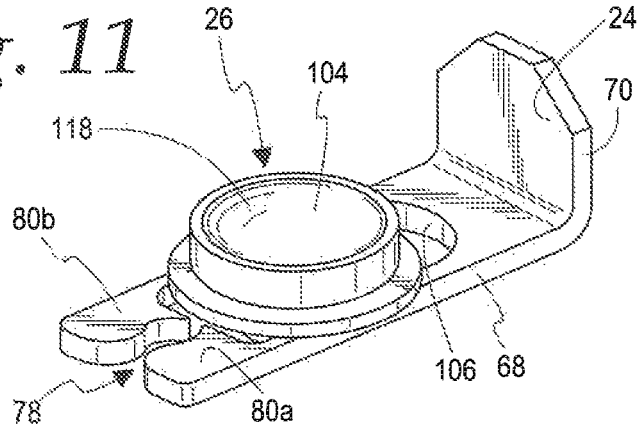
FIG. 11 is a perspective view of the latch component and latch control as shown in FIGS. 7 and 9.

The housing 12 has an overall cylindrical shape which, while not limiting, is a common convenient shape since it nominally conforms to the shape of the wrapped supply of tie wire 20, as depicted in FIG. 6, that is contained therein. This allows a relatively compact shape to be arrived at with a generally smooth outer annular shape which is not required to have sharp corners. This housing configuration lends itself to being attached to a belt 28 of a user by directing the belt 28 through complementary openings 29*a*, 29*b* defined by spaced connectors 30*a*, 30*b* at the bottom of the main housing part 14.

The main housing part 14 has a generally cylindrical cup shape defined by a base/bottom wall 32 and a peripheral wall 34 extending upwardly therefrom and around a turning axis 36 defined by a cantilevered spindle 38 also projecting upwardly from the base/bottom wall 32. The identifications "top", "bottom", etc., are arbitrary and used solely for purposes of defining relationships of parts.

The peripheral wall 34 has an outturned upper region at 40 extending around the opening 22 that is in communication with the storage space 18. This outturned configuration produces a convexly curved surface 42 that defines a seat for a complementary concave annular surface 44 on the cover part 16 with the main housing part 14 and cover part 16 in the assembled relationship of FIG. 5.

In this embodiment, a support 46 is located in the storage space 18, with the wrapped supply of tie wire 20 in turn placed against the support 46 to move therewith around the turning axis 36.

As depicted, the support consists of a hub 48 which surrounds the spindle 38 and is journaled for rotation relative thereto around the axis 36. In this embodiment, the base/bottom wall 32 has a thickened portion at 50 to provide a more stable foundation for the spindle 38 which is anchored therein.

The hub 48 on the support 46 has a female shape nominally conforming to the thickened portion 50 and has a bottom, outturned, annular flange 52 defining an axially facing surface 54 for supporting the wrapped supply of tie wire 20.

The peripheral wall 34 has at least one opening therein, and in this embodiment two openings 56*a*, 56*b* therein, through which a free end length 58 of the tie wire can be directed to allow the free end length 58 to be drawn radially outwardly to dispense the tie wire from the supply thereof. With the openings 56*a*, 56*b* at diametrically opposite locations, operation of the apparatus 10, when belt mounted on either of a user's sides, is facilitated. The openings 56 are configured and dimensioned so that in addition to facilitating dispensing of the tie wire, they permit visual inspection of the storage space 18 to allow determination of the amount of tie wire remaining therein without requiring separation of the cover part 16.

The cover part 16, in this embodiment, supports the latch component 24 and the latch control 26.

The cover part 16 consists of a first main piece 60, which is configured to block the opening 22 in communication with the storage space 18 adequately that with the main housing part 14 and cover part 16 in the assembled relationship, the wrapped supply of tie wire 20 within the storage space 18 cannot be separated from the main housing part 14. As depicted, with the main housing part 14 and cover part 16 in their assembled relationship, the spindle 38 centers the cover part 16 with respect to the main housing part 14 so that the concave annular surface 44 on the cover part 16 consistently aligns with, and nests conformingly against, the convexly curved surface/seat 42. At the same time, torque transfer features 62, 64, of suitable construction and respectively on the cover part 16 and support 46, consistently releasably engage in such a manner that the cover piece 60 is movable together with the support 46 around the turning axis 36.

Parts of the latch component 24 and latch control 26 are captively maintained between the first main cover piece 60 and a second main cover piece 66, which are maintained together by fasteners 67.

Figure 12:
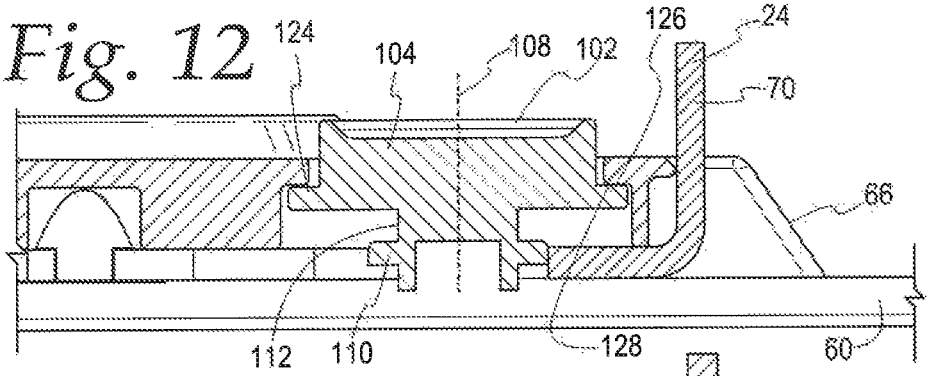
FIG. 12 is a view as in FIG. 9 and including additional pieces of the cover part with the latch component in the latched position and the latch control in the first state, wherein the actuator is in a first position and the latch component is blocked from being moved into the unlatched position.
Figure 14:
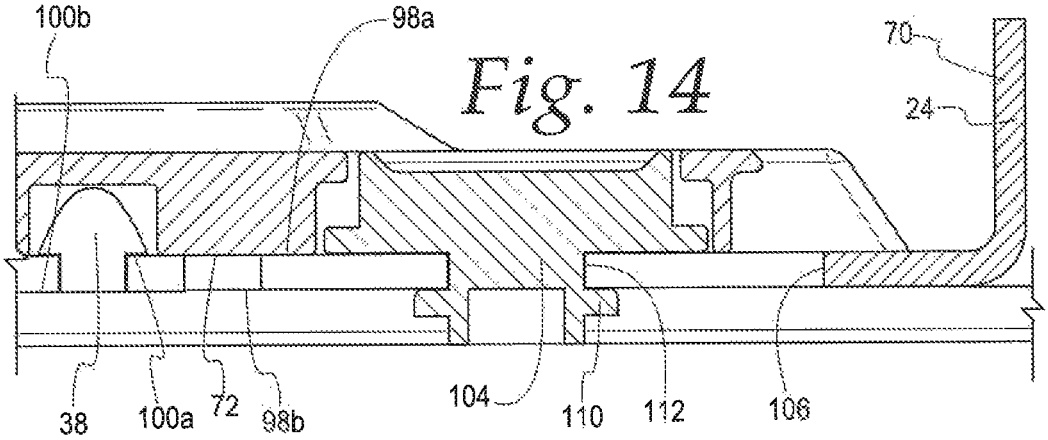
FIG. 14 is a view as in FIG. 13 wherein the latch component is moved into the unlatched position.

The latch component 24 is configured to translate between a latched position, as shown in FIG. 12, and an unlatched position, as shown in FIG. 14. This translational movement is guided cooperatively by, and in a space defined by, the first and second cover pieces 60, 66.

The exemplary latch component 24 has an overall "L" shape with transverse legs 68, 70. As depicted, both of the legs 68, 70 have a flat shape with the leg 68 guided within a complementary passage 72 defined between surfaces on the main cover pieces 60,66.

The leg 70 is configured to be grasped, as between the finger and thumb of a user, to facilitate manipulation of the latch component 24 and movement thereof between its latched and unlatched positions.

The leg 68 has an opening 74 therethrough which produces a bifurcated end 76 with a contoured passage 78 formed between spaced leg portions 80*a*, 80*b*. The leg portions 80*a*, 80*b* are configured to snap connect to an undercut region 82 on the spindle 38.

The passage 78 has an entry end 84 and a holding end 86. Adjacent to the holding end 86 are concave surface portions 88*a*, 88*b* opening towards each other and cooperatively defining a receptacle with a diameter D1 with the leg portions 80*a*, 80*b* in a relaxed state, as seen in FIG. 8. In the relaxed state, the diameter D1 is slightly less than a diameter D2 at the undercut region 82 of the spindle 38.

As the latch component 24 is advanced in the direction of the arrow 90 in FIG. 8 from the unlatched position into the latched position, the undercut spindle region 82 advances into the passage 78 at the entry end 84. Convex, spaced surface portions 92*a*, 92*b* cooperatively produce an hourglass-shaped configuration which at its narrowest neck portion at 94 has a width less than the diameter D2 of the undercut region 82. As the latch component 24 continues to advance in the direction of the arrow 90 through the passage 78, the leg portions 80*a*, 80*b* are wedged away from each other by the spindle 38, as indicated by the arrows 96. Once the undercut region 82 moves past the neck portion 94 closer to the holding end 86, restoring forces in the biased leg portions 80*a*, 80*b* cause the legs portions 80*a*, 80*b* to move towards each other and the surface portions 88*a*, 88*b* to thereby captively embrace the undercut region 82, whereupon the latched position of the latch component 24 is realized and releasably maintained. An exemplary snap fit connection as described is designed to engage under a force of 3-4 lbf.

The latch control 26 is provided to prevent inadvertent movement of the latch component 24 from the latched position into the unlatched position, as through application of an opposite force of a magnitude equal to that required to effect the snap fit connection between the latch component 24 and the spindle 38.

The undercut spindle arrangement causes oppositely facing surfaces 98*a*, 98*b* on the latch component 24 to be placed respectively in confronting relationship, one each, with axially oppositely facing surfaces 100*a*, 100*b* on the spindle 38 to thereby confine the latch component 24 movement in both axial directions relative to the spindle 38.

Accordingly, with the main housing part 14 and cover part 16 in their operative relationship, and the latch component 24 in the latched position, the main housing part 14 and cover part 16 are blocked from being moved axially away from each other.

In the depicted form, the latch control 26 consists of an actuator 102 with a body 104 that extends through the latch component opening 74, that consists of a first, circular portion 74*a*, partially bounded by an edge 106, which is in communication with a second opening portion 74*b* through a restricted neck portion 74*c*.

Figure 13:
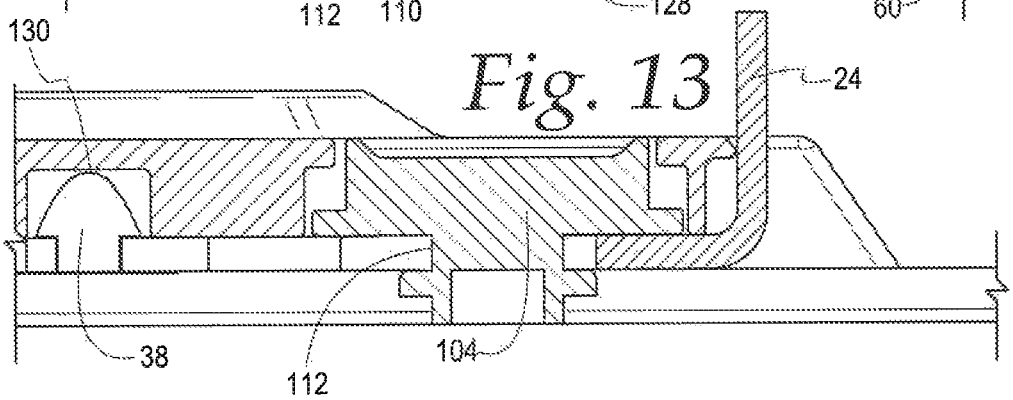
FIG. 13 is a view as in FIG. 12 wherein the actuator on the latch control is changed from the first position of FIG. 12 into a second position whereupon the latch control is placed in a second state wherein the latch component can be changed from the latched position into the unlatched position.

The actuator 102 is movable between a first position, as shown in FIG. 12, and a second position, as shown in FIG. 13. The latch control 26 is in the first state therefor with the actuator 102 in the first position, and in the second state therefor with the actuator 102 in the second position. As depicted, and without limitation, the body 104 of the actuator 102 has a central axis 108, with the body 104 being moved parallel to the axis 108 in changing between the first and the second positions.

The body 104 has first and second portions 110, 112, of different configuration, spaced along the axis 108. The body 104 is configured so that with the body 104 in the first position, the first portion 110 of the body 104 moves into a path of the edge 106, with the latch component in the latched position and urged towards the unlatched position. The edge 106 thus blocks movement of the latch component 24 from the latched position into the unlatched position. This blocking results from the first portion 110 having a shape/size that cannot translate through the neck portion 74*c*.

With the body 104 in the second position, the second portion 112 of the body 104 is moved into the latch component opening portion 74*a* and, as the latch component 24 moves from the latched position into the unlatched position, there is no interference from the edge 106. That is, the first portion 110 moves fully through the opening 74 so that the edge 106 does not block movement of the latch component 24 from the latched position into the unlatched position.

A coil spring 114, or another type of biasing structure, acts between the cover part 60 and the body 104 to bias the body 104 towards its first position.

In the depicted form, which should not be viewed as limiting, the first portion 110 of the body 104 has a circular outer edge 116 that has a diameter that is slightly less than an effective diameter of the edge portion 106, which is shown with a complementary shape. With the body 104 in the first position, the outer edge 116 axially aligns with the edge portion 106, and is engageable therewith, over spaced circumferential regions R1, R2 to positively block movement of the latch component 24 from the latched position into the unlatched position.

The top of the body 104 is provided with a concave pushing surface 118 into which a user's fingertip can comfortably nest while exerting an axial force adequate to overcome the force produced by the coil spring 114 to depress the body 104 to change it from its first position into its second. Once the second position is realized, the second portion 112 axially aligns within the thickness of the latch component leg 68 and, as explained above, does not interfere with movement of the latch component 24 from the latched position into the unlatched position.

The opening 74 and body portions 110, 112 may take virtually an unlimited number of different forms and relationships. As depicted, the opening 74 is contiguous with the passage 78. Adjacent the holding end 86 of the passage 78, the second opening portion 74*b* has a wide rectangular shape which is provided primarily to allow the leg portions 80*a*, 80*b* to flex away from each other to permit the snap fit connection, described above.

With the second portion 112 having a similar annular outer shape as the first portion 110, but of smaller diameter, with the latch control 26 in the second state, the second portion 112 can advance freely through the neck portion 74*c* to allow the latch component 24 to change from the latched position into the unlatched position.

The body 104 has an upper annular rim 124 with an upwardly facing surface 126 that is abuttable to a shoulder/surface 128 on the cover piece 66. With this arrangement, the spring 114 biases the body into its first position which is consistently established as the surfaces 126, 128 confront.

In the depicted embodiment, the spindle axis 36 extends through the wrapped supply of tie wire 20 in the operative position therefor, with the axis 108 of the body being substantially parallel thereto. However, this is not a requirement.

With the main housing part 14 and cover part 16 separated as in FIG. 6, the wrapped supply of tie wire 20 can be advanced through the opening 22 into the storage space 18 with the free end length 58 directed through one of the peripheral wall openings 56 on the main housing part 14.

The cover part 16 can then be lowered into place, with centering facilitated by having a rounded and tapered leading end 130 on the spindle 38. With the cover part 16 fully seated, in this embodiment, the actuator body 104 is moved from its first position into its second position to allow the latch component 24 to be moved from its unlatched position into its latched position. An alternative design is contemplated wherein the actuator 102 does not have to be changed in position to allow initial latching to take place.

Once the cover part 16 is latched, the cover part 16 and support 46 are movable together with the wrapped supply of tie wire 20.

The ability to turn the wrapped supply of tie wire 20 relative to the main housing part 14 facilitates retrieval of paid out tie wire and also permits dispensing, depending upon the direction of turning.

To facilitate turning of the cover part 16, support 46, and wrapped supply of tie wire 20 in the operative position, a post 132 is formed on the cover piece 60 and projects axially at a location spaced from the axis 36. A comfortably grippable component 134 is attached to the post 132 to define a gripping knob to facilitate movement of the cover part.

Figure 15:
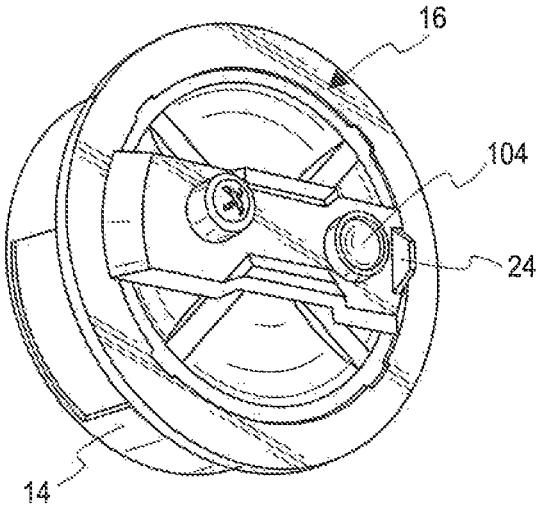
FIG. 15 is a top perspective view of the apparatus with the latch component in the latched position and the latch control in the first state wherein the latch component is blocked from being changed into the unlatched position.
Figure 16:
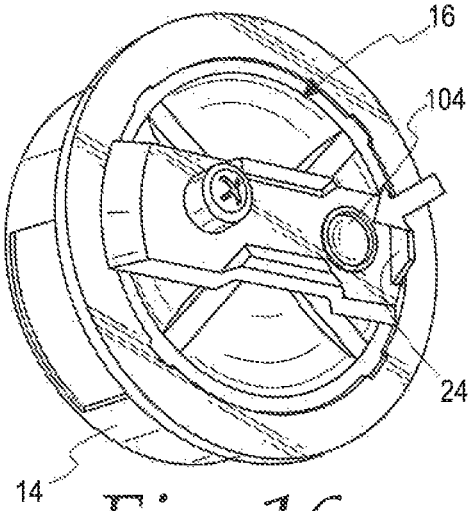
FIG. 16 is a view as in FIG. 15 wherein an actuator body on the latch control has been pressed to change the latch control into the second state wherein the latch component can be changed from the latched position into the unlatched position.
Figure 17:
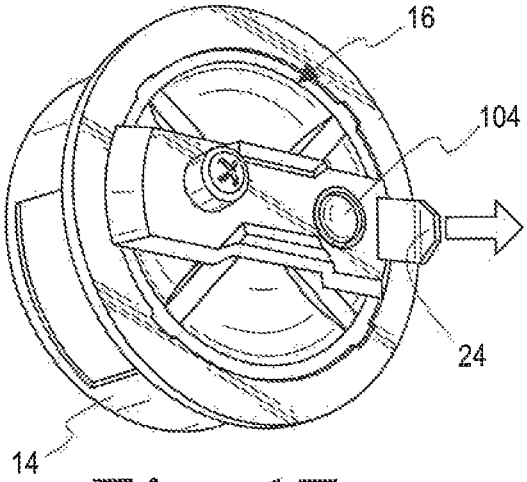
FIG. 17 is a view as in FIG. 16 wherein the latch component has been changed to the unlatched position.
Figure 18:
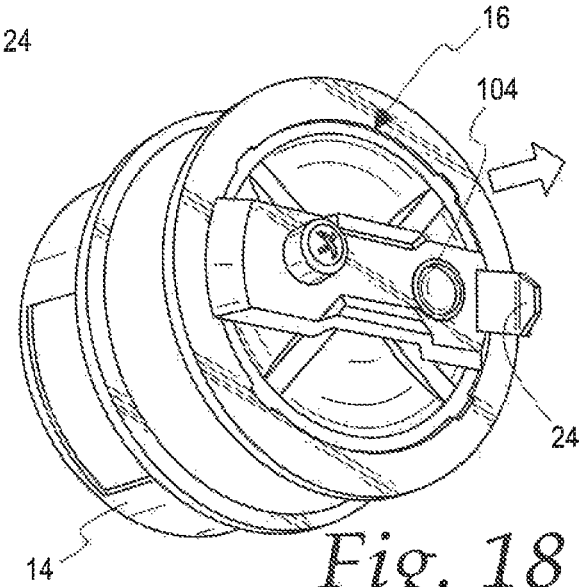
FIG. 18 is a view as in FIG. 17 wherein the cover part is being separated from the main housing part.

When it is desired to separate the cover part 16 from the main housing part 14, be it to load or unload a wrapped supply of tie wire, the actuator body 104 is depressed and thereby moved from its first position of FIG. 15 into its second position of FIG. 16, as previously described. The latch component 24 can then be moved from the latched position of FIG. 16 into the unlatched position of FIG. 17, whereupon the cover part 16 can be drawn axially away from the main housing part 14 as shown in FIG. 18.

To provide leverage to the user when depressing/pushing the actuator body 104, at least one, and in this case two, receptacles 136*a*, 136*b* are provided in spaced relationship with each other and the actuator body 104. The receptacles 136*a*, 136*b* are generally concave, opening axially downwardly to produce surrounding surfaces/edges 138*a*, 138*b* against which one or more of the user's fingers/digits can be borne and braced as the user's same hand is positioned to apply a force through another digit thereon to the actuator body 104 to change the position thereof. As just one example, an index finger on one hand can be directed into one of the receptacles 136 and wrapped against/around the respective edge 138 while the thumb on the same hand is utilized to depress the actuator body 104.

The foregoing disclosure of specific embodiments is intended to be illustrative of the broad concepts comprehended by the invention.

The invention claimed is:

1. An apparatus for dispensing tie wire, the apparatus comprising:

a housing comprising a main housing part and a cover part, the main housing part defining a storage space for a wrapped supply of tie wire, the main housing part having a housing part opening through which a wrapped supply of tie wire can be directed to be placed in an operative position, the cover part configured to be releasably joined with the main housing part to thereby place the main housing part and cover part in an assembled relationship wherein a wrapped supply of tie wire in the operative position is blocked in the operative position;

a latch component that is selectively movable between latched and unlatched positions, the latch component in the latched position preventing the main housing part and cover part from being changed from the assembled relationship, wherein with the latch component in the unlatched position the main housing part and cover part are changeable from the assembled relationship whereby a wrapped supply of tie wire can be one of: a) directed through the main housing part opening into the operative position; and b) removed from the operative position in the storage space through the main housing part opening; and a latch control selectively changeable between first and second states in response to a first actuating force input by a user, the latch control configured so that: i) with the latch control in the first state, the latch control blocks the latch component from moving from the latched position into the unlatched position; and ii) with the latch control in the second state, the latch component can be moved from the latched position into the unlatched position in response to a second actuating force input by a user that is different than the first actuating force.

2. The apparatus for dispensing tie wire according to claim 1 in combination with a wrapped supply of tie wire.

3. The apparatus for dispensing tie wire according to claim 1 wherein the latch component is translatable between the latched and unlatched positions.

4. The apparatus for dispensing tie wire according to claim 2 wherein the housing has at least one discharge opening through which an end length of the wrapped supply of tie wire in the operative position can be directed, the wrapped supply of the wire in the operative position movable around a turning axis relative to the main housing part as the end length of the tie wire is drawn away from the housing to thereby dispense the tie wire.

5. The apparatus for dispensing tie wire according to claim 4 wherein the main housing part has a cantilevered spindle defining the turning axis and the latch component in the latched position engages the cantilevered spindle.

6. The apparatus for dispensing tie wire according to claim 5 wherein with the main housing part and cover part in assembled relationship and the latch component in the latched position, axially oppositely facing surfaces on the latch component and cantilevered spindle are in confronting relationship and the latch component blocks the main housing part and cover part from being moved axially away from each other.

7. The apparatus for dispensing tie wire according to claim 3 wherein the latch control comprises an actuator that extends through a latch component opening in the latch component bounded by at least one edge.

8. The apparatus for dispensing tie wire according to claim 7 wherein the actuator is movable between a first position and a second position, the latch control in the first state with the actuator in the first position and in the second state with the actuator in the second position.

9. The apparatus for dispensing tie wire according to claim 8 wherein the actuator has a body with a first axis and the body is moved parallel to the first axis in changing between the first and second positions.

10. The apparatus for dispensing tie wire according to claim 9 wherein the body has first and second portions spaced along the first axis and with different configurations, the body configured so that: a) with the body in the first position, the first portion of the body abuts the at least one edge to block movement of the latch component from the latched position into the unlatched position; and b) with the body in the second position the second portion of the body is movable within the latch component opening without blocking movement of the latch component from the latched position into the unlatched position.

11. The apparatus for dispensing tie wire according to claim 10 wherein the body is spring biased towards the first position.

12. The apparatus for dispensing tie wire according to claim 11 wherein the cover part has a stop surface that faces axially with respect to the first axis and the body has a surface that faces oppositely to the stop surface and abuts the stop surface so that the body is consistently biased into the first position.

13. The apparatus for dispensing tie wire according to claim 10 wherein the main housing part has a cantilevered spindle defining a turning axis that extends through the wrapped supply of tie wire in the operative position and the turning axis is substantially parallel to the first axis.

14. The apparatus for dispensing tie wire according to claim 6 wherein the cantilevered spindle and latch component are configured so that as an incident of the latch component being translated from the unlatched position into the latched position the latch component reconfigures such that the latch component is biasedly snap-connected to the cantilevered spindle with the latch component in the latched position.

15. The apparatus for dispensing tie wire according to claim 7 wherein the latch component has an "L" shape with transverse legs, the latch component opening defined through one of the transverse legs, the other of the transverse legs configured to be grasped to facilitate movement of the latch component between the latched and unlatched positions.

16. The apparatus for dispensing tie wire according to claim 2 further comprising a support that is mounted to the main housing part for movement relative to the main housing part around a turning axis, the wrapped supply of tie wire in the operative position placed against the support and movable with the support around the turning axis.

17. The apparatus for dispensing tie wire according to claim 10 wherein the cover part comprises at least first and second pieces which at least partially captively maintain the latch component and the body.

18. The apparatus for dispensing tie wire according to claim 17 wherein the body is spring biased towards the first position and at least one of the first and second pieces has at least one surface facing along the first axis in one direction and the body is advanced along the first axis in the one direction in moving from the first position into the second position, the at least one surface configured so that a user can brace at least a digit on one hand against the at least one surface while exerting a force on the body with another digit on the one hand that urges the body from the first position towards the second position.

19. The apparatus for dispensing tie wire according to claim 18 wherein the at least one of the first and second pieces defines at least one concave receptacle.

20. The apparatus for dispensing tie wire according to claim 16 wherein the cover part is engageable with the support to move with the support around the turning axis and the cover part comprises a projecting knob spaced from the turning axis and configured to be graspable by a user to facilitate moving of the cover part and support around the turning axis.

* * * * *